United States Patent [19]

Olasz et al.

[11] 4,426,948

[45] Jan. 24, 1984

[54] YARN DETECTOR FOR SHORT SEAM SEWING MACHINES

[75] Inventors: Sandor Olasz; Denes Szalay; Jozsef Kovacs; Oliver Kocsis, all of Budapest, Hungary

[73] Assignee: Csepel Muvek Jarmu es Konfekcioipari Gepgyara, Budapest, Hungary

[21] Appl. No.: 265,083

[22] Filed: May 19, 1981

[30] Foreign Application Priority Data

May 28, 1980 [HU] Hungary ..... 1338/80

[51] Int. Cl.[3] ..... D05B 69/36

[52] U.S. Cl. ..... 112/273; 112/278

[58] Field of Search ..... 112/273, 278, 275, 277; 139/273 A; 250/559, 561

[56] References Cited

U.S. PATENT DOCUMENTS

| | | | |
|---|---|---|---|
| 2,557,533 | 6/1951 | Corl | 139/273 A UX |
| 3,587,497 | 6/1971 | Beazley | 112/273 X |
| 4,192,243 | 3/1980 | Blessing et al. | 112/273 |

*Primary Examiner*—Peter P. Nerbun

*Attorney, Agent, or Firm*—Young & Thompson

[57] ABSTRACT

Yarn break in a short seam sewing machine is determined by detection of yarn swinging and wherein the sewing machine is stopped in response to the detection.

5 Claims, 2 Drawing Figures

YARN DETECTOR FOR SHORT SEAM SEWING MACHINES

Figure 1:
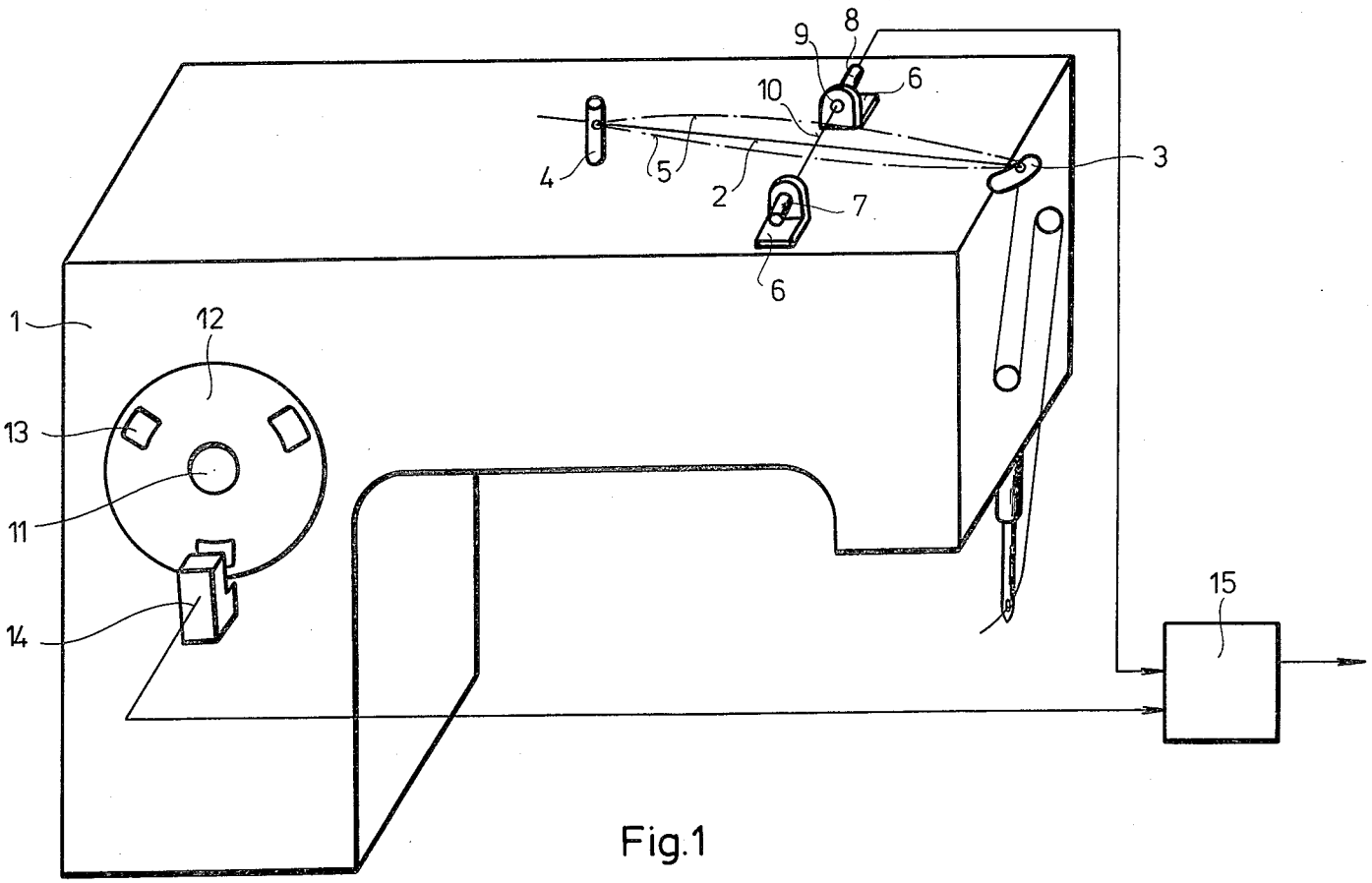

The invention relates to a yarn detector for short seam sewing machines provided with thread guides, a control disc having a driving shaft and a control unit, wherein a yarn is drawn through the thread guides.

The yarn observer as in this invention is a device which observes the yarn breaks or run-out and other disturbances such as lost stitches, and in the case of failures intervenes in the function of the sewing machine.

In the case of the known yarn detectors, the tightness of the yarn is observed with the help of thread guides which will be moved on the impact of expanded yarn. At yarn break or run-out, the yarn will no more be expanded, thus, the guide will not move, which is sensed and displayed by the yarn detector. It will intervene into the function of the sewing machine, e.g. it will be immediately stopped.

This type of yarn guides can be used with sewing machines producing long seams without any difficulties, since there is always a part of the yarn which is tight in the course of sewing. But with short seam sewing machines, these yarn detectors cannot be used because, there is no part of the yarn which is tight. On the other hand, it would be inconvenient or in some cases even impossible with a view to the technical attributes of the short seam sewing machines if they were stopped immediately after sensing a failure. It follows that the conventional yarn detectors cannot be used with short seam sewing machines.

Therefore, the first and main object of our invention is to create a yarn detector in which all inconveniences of the known types are eliminated and which can be used with short seam sewing machines and can be mounted on the old machines of this type, too, and which stops the machine after detecting a failure only at the end of the seam.

The basic idea of our invention is that instead of the tightness of the yarn, its swinging should be observed, since in the case of yarn break or other failure this swinging will be stopped, the detection of which can result in an error signal.

The improvement, i.e. the invention itself is that a light source and a light-sensing device are provided for detecting the swinging of the yarn drawn through the thread guides and swinging between the guides in the course of sewing and on the driving shaft of the control disc, another disc is fixed which has as many openings as short seams are made during one revolution of the control disc, and parallel to the second disc, a detector observing the openings of this disc is arranged, and an output of the light-sensing device and an output of the detector are connected to a control circuit wired to the control unit of the sewing machine.

Other objects and details of our invention will be described hereinafter with reference to the attached drawings. In the drawings, FIG. 1 shows a first embodiment of the yarn detector of our invention mounted on a sewing machine, in schematic perspective, FIG. 2 illustrates another embodiment in perspective.

Figure 2:
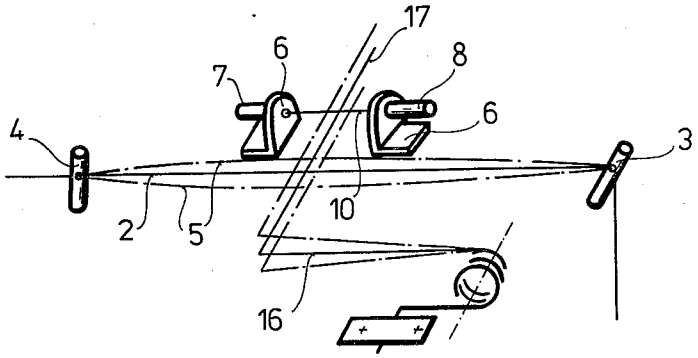

In a sewing machine 1 shown in FIG. 1, a yarn 2 is drawn through thread guides 3 and 4. The yarn 2 swings in the course of the sewing operation, and the limits of this swinging are shown by dash-and-dot line 5.

On one side of the yarn 2, a casing 6 is provided for a light source 7 and on the other side of yarn 2 another casing 6 for a light-sensing device 8. The casings 6 on both sides of the yarn 2 are arranged in such a way that a light beam 10 emitted from light source 7 and received through a diaphragm 9 in light-sensing device 8 is interrupted by yarn 2 swinging between limits 5. The signal from light-sensing device 8 is forwarded to a control circuit 15.

Light source 7 can be formed as a light emitting diode (LED) or infrared source and light-sensing device 8 as a phototransistor or an infrared receiver, respectively. In the embodiment shown in FIG. 1, light source 7 and light-sensing device 8 are formed as a photocell unit.

The finishing of a seam can be detected by fixing a disc 12 on a driving shaft 11 of the control disc of sewing machine 1. (This control disc is part of every up-to-date sewing machine, therefore, it is not part of our invention.) In disc 12, openings 13 are provided in a number which corresponds to the number of seams produced during one rotation of the control disc and thus, of disc 12.

The openings 13 of rotating disc 12 are observed by a detector 14. Between adjacent openings 13, an angular distance is provided, which corresponds at a given rotational speed of disc 12 to a time needed for—except some last stitches—finishing a seam.

In FIG. 1, the embodiment has a disc 12 with three openings 13, thus, three short seams are made during one rotation of disc 12.

For detector 14, a detector using any kind of light can be provided, too, but in this embodiment, a per se known induction detector is built in. Therefore, disc 12 is made here of metal.

Light-sensing device 8 and detector 14 are connected to control circuit 15 which is wired to a control unit of the sewing machine 1. Such a control unit is provided in every sewing machine. Control circuit 15 delivers a signal to the control unit to stop sewing machine 1 when its output is switched "high" (logical 1). This should be done when in front of detector 14, an opening 13 of disc 12 arrives, thus, detector 14 becomes illuminated and at the same time, light-sensing device 8 delivers not an interrupted, but rather a continuous signal. This problem is solved in this embodiment by providing in control unit 15 a sweep circuit with two stable settings. To one of its inputs, detector 14 is connected through a differentiator member, to another input, light-sensing device 8 through a negator.

The yarn detector according to our invention operates as follows.

At the beginning of the sewing operation, the output of control circuit 15 is set to "low" (logical 0), in front of detector 14 one of the openings 13 is disposed, thus it is illuminated, its output is set high (logical 1), and light beam 10 is interrupted by swinging yarn 2. During the operation, the solid part of disc 12 will rotate past detector 14, which will thus be dark, logical 1 will be changed to 0. To this change, the differentiator member does not react, to the sweep circuit, signal will not be forwarded (logical 0). In the course of sewing, the setting of this branch will not change, since detector 14 is continuously shadowed by the solid part of disc 12. The next opening 13 will rotate to detector 14 while making the last stitches before finishing the seam. In detector 14, low (logical 0) will be changed to high (logical 1), the differentiator member reacts and a signal (logical 1) will be forwarded, the input of the sweeping circuit will be set to high (logical 1). When at the same time the yarn 2 is swinging, and the interrupted signal is coming to the negator from the light-sensing device 8, the first interruption (logical 0, through the negator logical 1) will set the output of the sweep circuit to high (logical 0), thus, after finishing the steam, no signal will be forwarded to the control unit causing the stoppage of the further operation of the sewing machine 1. If the yarn 2 does not swing, there will not be forwarded an interruption (logical 0) to control circuit 15, after negator logical 1 to the sweeping circuit, and on the output of the sweep circuit logical 1 will stay which prevents sewing machine 1 from the further operating.

The signal in light-sensing device 8 is generated by interrupting light beam 10 by yarn 2. The different qualities of the sewing yarns can influence the quality of signals generated in light-sensing device 8. This fact can reduce the operational reliability of control circuit 15. This problem is eliminated in another preferred embodiment of our invention shown in FIG. 2.

As illustrated in FIG. 2, the light beam 10 is not directly interrupted by yarn 2, but with the help of a spring wire 16 which is fixed on sewing machine 1 and is disposed at an angle (here 90°) relative to yarn 2. The spring wire 16 has an elongated end 17, which is in the way of the swinging of yarn 2, between limits 5. The end 17 is moved by yarn 2, the swinging of which is followed by the spring wire 16. This elongated end 17 extends through light source 7 and light-sensing device 8 both of them being mounted on the same side of yarn 2 on sewing machine 1. Spring wire 16 is made of a soft spring material, thus its low spring force will not influence the swinging of yarn 2. The lay-out and operation of this embodiment are in other respects the same as described in connection with FIG. 1.

What we claim is:

1. In a detector for short seam sewing machines (1) provided with thread guides (3 and 4), a control disc having a driving shaft (11) and a control unit, wherein a yarn (2) drawn through said thread guides (3 and 4) swings between the thread guides (3 and 4) in the course of sewing; the improvement comprising a light source (7) and a light-sensing device (8) for detecting the swinging of the yarn; another disc (12) fixed on the driving shaft (11) of said control disc and having as many openings (13) as there are short seams to be made during one revolution of said control disc;

parallel to the disc (12), a detector (14) observing the openings (13) of the disc (12); and an output of the light-sensing device (8) and an output of the detector (14) being connected to a control circuit (15) electrically connected to said control unit of the sewing machine (1).

2. Yarn detector as claimed in claim 1, said light source (7) being mounted on one side of the yarn (2) on the sewing machine (1) and said light-sensing device (8) on the other side of the yarn (2).

3. Yarn detector as claimed in claim 1, said light source (7) and said light-sensing device (8) being mounted on the same side of the yarn (2) on the sewing machine (1), and a spring wire (16) having an elongated end (17) being fixed to the sewing machine (1) in the of swinging of the yarn (2), said elongated end (17) extending through the light source (7) and the light-sensing device (8).

4. Yarn detector as claimed in claim 1 said light source (7) and said light-sensing device (8) being formed as a photocell unit and said detector (14) as an induction detector.

5. Yarn detector as claimed in claim 1 said control circuit (15) being provided with a sweep circuit.

* * * * *